United States Patent [19]

Lamb

[11] Patent Number: 4,655,427

[45] Date of Patent: Apr. 7, 1987

[54] MUSIC PAGE HOLDER AND TURNER

[76] Inventor: William C. Lamb, 2909 Woodland Ave., Des Moines, Iowa 50312

[21] Appl. No.: 787,163

[22] Filed: Oct. 15, 1985

Related U.S. Application Data

[63] Continuation-in-part of Ser. No. 681,282, Dec. 13, 1984, abandoned.

[51] Int. Cl.[4] ..... A47G 29/00

[52] U.S. Cl. ..... 248/460; 248/444.1; 281/45

[58] Field of Search ..... 248/443, 459, 460, 441.1, 248/442.2, 447.1, 450, 461; 281/33, 45; 84/486

[56] References Cited

U.S. PATENT DOCUMENTS

| | | | |
|---|---|---|---|
| 1,207,456 | 12/1916 | Whelan | 84/486 X |
| 1,416,903 | 5/1922 | Stalling | 281/45 |
| 2,573,191 | 10/1951 | Finch | 281/33 |
| 3,367,679 | 2/1968 | Slanhoff | 248/459 X |
| 3,643,363 | 3/1970 | Biro | 281/45 X |
| 4,460,146 | 7/1984 | Raggiotti | 248/460 X |

FOREIGN PATENT DOCUMENTS

| | | | |
|---|---|---|---|
| 725422 | 3/1955 | United Kingdom | 281/45 |

*Primary Examiner*—J. Franklin Foss
*Attorney, Agent, or Firm*—Henderson & Sturm

[57] ABSTRACT

This invention relates to an apparatus for aiding the holding and turning of bound sheet music, which apparatus comprises a holder having left and right pockets formed internally of backing members for firmly grasping music pages which are not presently being played, leaving free those pages which are to be played, and incorporates transparent stiffening members for each free page to ensure its laying flat against the held pages, to each stiffening member including a color coded tab member for separating and quickly engaging each page, and an element formed on each backing member for placing the music at a height above the bottom edges of the backing members such that the music pages swing freely and without engaging a conventional restraining ridge normally found on a music supporting instrument.

6 Claims, 13 Drawing Figures

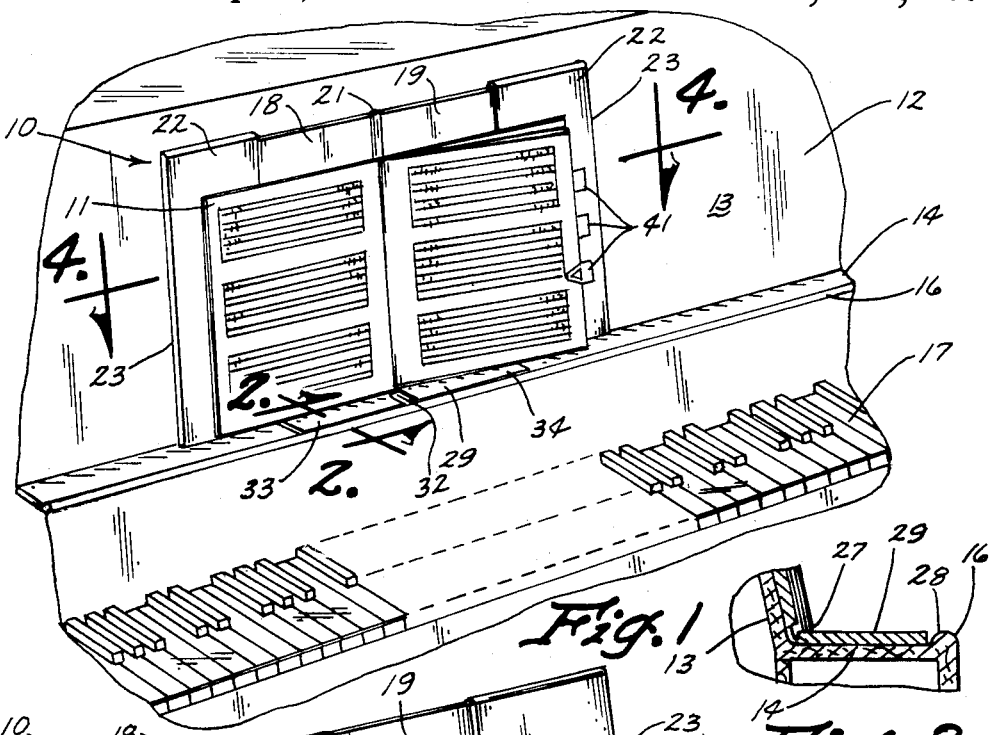
Fig. 1
Fig. 2
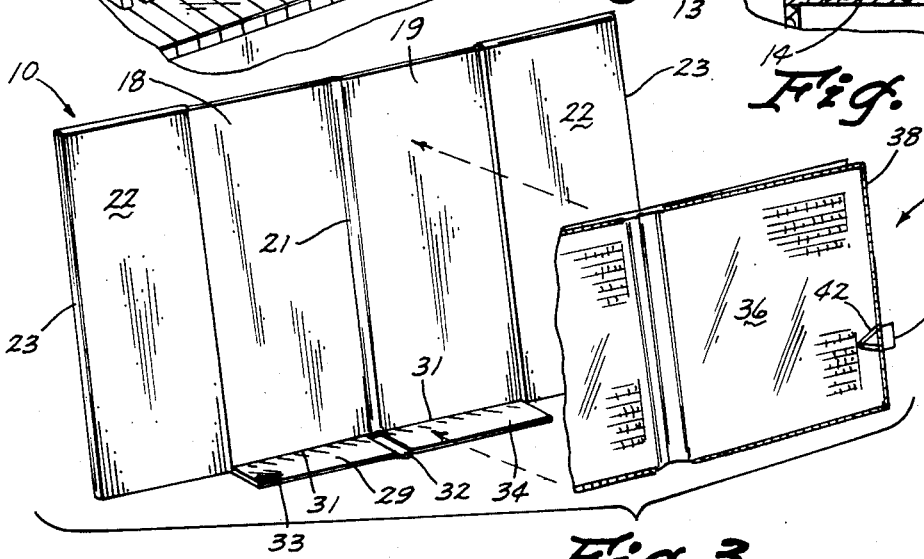
Fig. 3
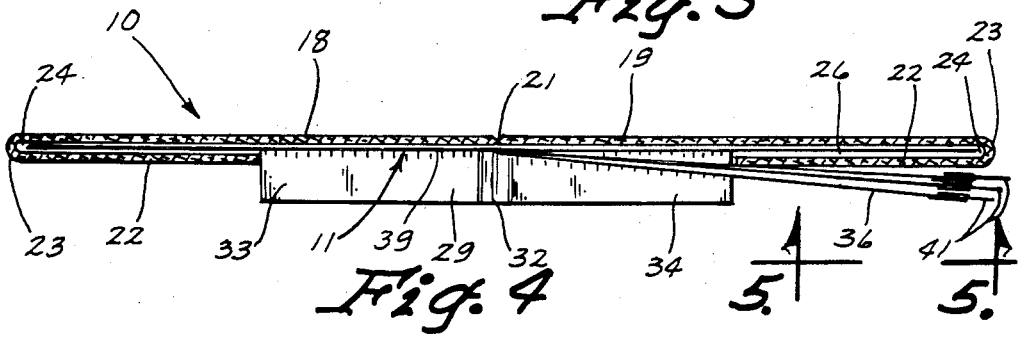
Fig. 4

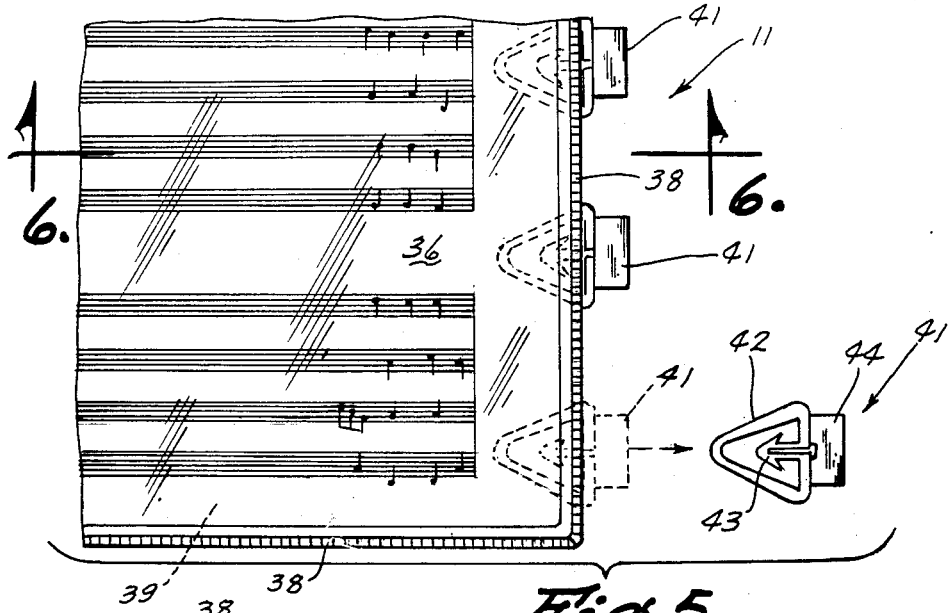
Fig. 5
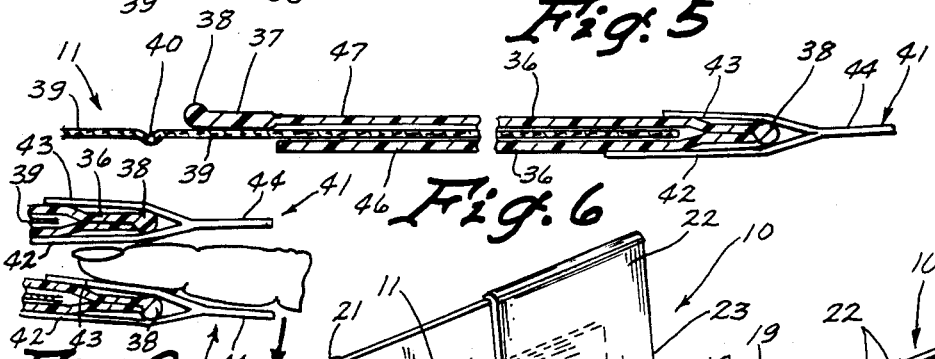
Fig. 6
Fig. 8
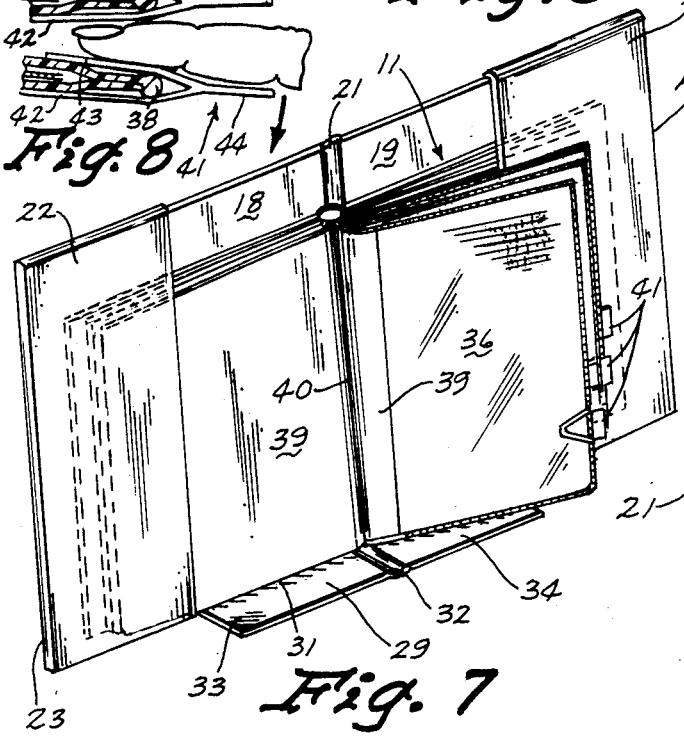
Fig. 7
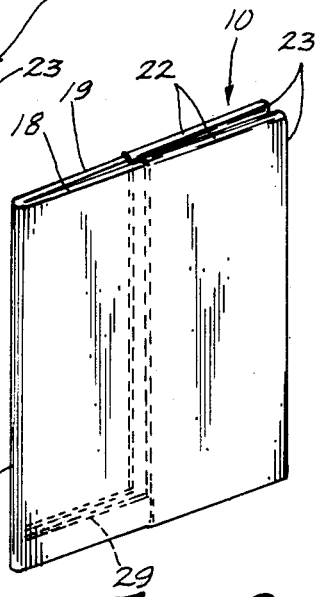
Fig. 9

MUSIC PAGE HOLDER AND TURNER

This is a continuation-in-part of co-pending application Ser. No. 06/681,282 filed on Dec. 13, 1984, now abandoned.

TECHNICAL FIELD

The present invention relates generally to an apparatus used for holding sheet music. The purpose of the invention is to support the sheet music such that the pages to be played rest open and relatively flat against the music support, and are freely and quickly turnable by the player without soiling or damaging the pages.

BACKGROUND ART

For many, many years musicians have had the extremely vexing problem of properly supporting and holding their sheet music, whether bound or not; and particularly when placed on the piano, organ, music stand or the like instrument, such that they can quickly and easily turn the pages as they play or read from the music. Their problem is exacerbated by a number of items apparently inherent in the instruments and music they must use.

The instruments themselves normally have a back support and a ledge or shelf for holding the music open, but to keep the music from slipping off the shelf a restraining ridge along the front is provided. In some cases this ridge is quite pronounced. The disadvantage of the ridge is that is can obstruct the free turning of the pages, thereby causing some tearing and other mutilation of the pages, not to mention the stress on the musician.

Certain sheet music is either extremely flimsy and thus difficult to grasp and turn without damage; while other, such as tightly bound music books have such a tension that the pages actually "float" or stand out from the book, refusing to lay flat against the back support.

Page turning has always been a problem for the musician, due primarily to the pages which rest closely against each other such that it is extremely difficult for the musician to quickly grasp and turn the page.

A number of mechanical devices have been developed to try to aid the musician to solve these difficulties, all without success, although the use of spiral and ring binding have helped with page flotation. An example is U.S. Pat. No. 1,023,403 to Willi which shows a complicated mechanical music page holder and turner. Musicians themselves manipulate and otherwise work—as by folding pages, pasting, etc. in order to try to solve these problems. But the trail of soiled and torn lower outer corners of well used music books, and the frustrated and embittered musicians gives evidence of these problems being in the main unsolved.

DISCLOSURE OF THE INVENTION

The above problems are substantially resolved by the provision of the invention disclosed herein.

The present invention comprises a music holder apparatus which includes a book-like pair of backing members flexibly connected along their inner edges such that they may lay flat and outspread against the back of a music stand or the like, or may be completely folded together, as a book. A pocket is formed on the inner face of each backing member by a cover piece whereby one or more pages of music from a book of music, for example, may be removably held within each pocket.

When a certain group of pages are to be used, the music pages in front thereof may be inserted in the left pocket, and the music pages following may be inserted in the right backing member pocket, leaving the pages from which to be played free and not held.

Near the lower edge or base of the connected backing members, the combined backing members and cover pieces are formed so as to hold and support the sheet or bound music above the bottom edges of the backing members, and thus to support the music above any support surface of an instrument on which the apparatus may be supported.

The holder apparatus includes transparent envelopes, each for enveloping a page such as to stiffen each page; and also to prevent it from floating free, the stiffening enabling the page to lay flat to the right or left. The transparency allows the music to be seen on both sides of the page. Integral with or attached to each stiffening envelope is a color tab which is specially designed to separate and identify by color the pages in progression, and also to facilitate page turning.

BRIEF DESCRIPTION OF THE DRAWINGS

These and other attributes of the invention will become more clear upon a thorough study and review of the following detailed description of the best mode for carrying out the invention, particularly when reviewed in conjunction with the drawings, wherein:

FIG. 1 comprises a fragmentary perspective view of the music holder assembly of this invention, shown in use on a conventional upright piano;

FIG. 2 is an enlarged, fragmentary sectional view taken along the line 2—2 in FIG. 1;

FIG. 3 is an enlarged perspective view of the music holder assembly of this invention, partly exploded and partly fragmentary;

FIG. 4 is an enlarged sectional view taken along the line 4—4 in FIG. 1;

FIG. 5 is a further enlarged, fragmentary view taken along the line 5—5 in FIG. 4, and showing a tab in exploded manner;

FIG. 6 is a sectional view taken along the line 6—6 in FIG. 5;

FIG. 7 is a perspective view similar to FIG. 3 and showing the music holder assembly holding a book of music;

FIG. 8 is a fragmentary horizontal sectional view of a plurality of outer edges of the music page stiffener and tab units, with a finger of the player being partially inserted to turn the outer page;

FIG. 9 is a slightly reduced perspective view of the music holder assembly in folded condition;

BEST MODE FOR CARRYING OUT THE INVENTION

Figure 10:
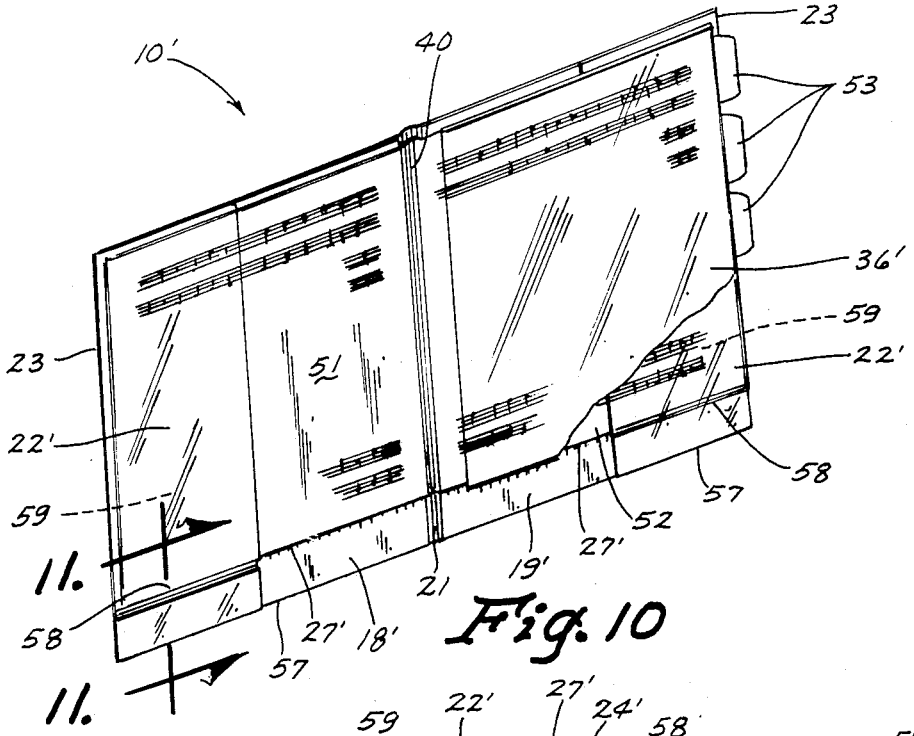
FIG. 10 shows in perspective a second embodiment of the invention, the music holder assembly in an open position.
Figure 11:
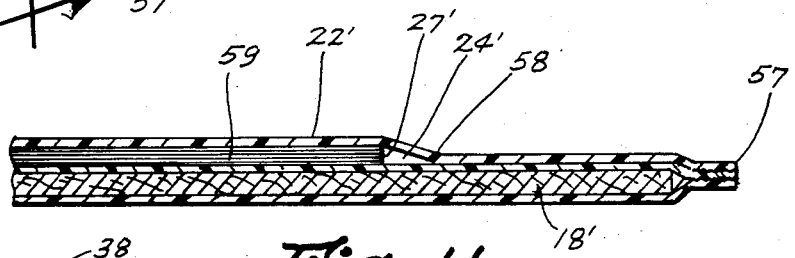
FIG. 11 is an enlarged fragmentary sectional view taken along the line 11—11 in FIG. 10.
Figure 12:
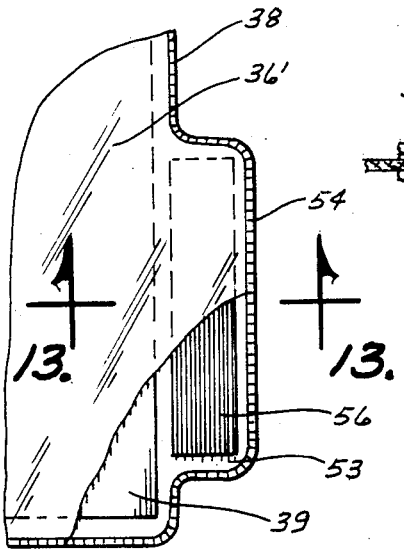
FIG. 12 is an enlarged detail view of one tab arrangement from FIG. 10.

Referring to the drawings, particularly FIGS. 1–9, the music page holder and turner assembly of this invention is indicated generally by reference numeral 10.

The holder assembly (10) is shown holding a pamphlet (11) of bound sheet music on an upright piano (12). The piano (12) has an upright, slightly rearwardly slanted front portion (13) against which the holder assembly (10) rests, a generally horizontal shelf or ledge (14) for supporting the holder assembly (10), and a restraining ridge (16) provided at the outer edge of the ledge (14) above the keyboard (17) to keep the music holder (10) from slipping off the ledge (14).

The music holder (10) comprises a pair of rectangular, flat backing members (18), (19) interconnected at a flexible joint (21) so as to move from a flat, outspread condition (FIG. 3) to a folded condition (FIG. 9). A portion of each backing member (18), (19) is covered over by a front cover piece (22) having the same height as the backing members and integral therewith, the outer edge (23) of the holder (10) at edge side being closed thereby, and a pair of pockets (24), (26) (FIG. 4) being formed between the front surface of each backing member and the rear surface of each cover piece (22).

To raise the bottom edges (27) (FIG. 2) of the music (11) to a level substantially the same as the upper edge (28) of the restraining edge (16), a riser flap (29) (FIGS. 1–4) is provided. The flap (29) is flexibly joined to the lower edge (31) of the central portions of the backing members (18), (19) between the pockets (24), (26), and is adapted to support the music (11) held within the holder (10), and to rest upon the piano ledge (14). As with the backing members (18), (19), the riser flap (29) also has a flexible joint (32) centrally thereof which enables the outer wings (33), (34) of the flap (29) to not only fold upwardly against the backing members (18), (19), but also to fold together as best illustrated in FIG. 9.

Page stiffeners (36) are provided to keep certain music pages from floating, each stiffener comprising an envelope of transparent material having a thickened portion (37) (FIG. 6) and a ribbed edge (38) around the three closed edges of the page stiffener (36). As shown in FIG. 6, a sheet (39) of music extended outwardly from the center fold (40) is readily insertable into the envelope formed by the page stiffener (36), and as the panels of the stiffener (36) are transparent, the material printed on both sides of the music sheet (39) is easily read.

The sheet music holder assembly (10) is completed by the provisions of a tab (41) (FIGS. 5–8) for each page stiffener (36). The tabs (41) shown here are of a plastic material and are releasably engagable with the outer ribbed edge (38) of each stiffener (36), although each tab (41) includes a triangular portion (42) and an arrow portion (43) adapted to engage opposite sides of the tab (41) edge (38) as best seen in FIG. 6, with an outwardly extended portion (44) provided for finger grasping.

The dimensions of the music holder assembly (10) are relevant only to the extent it is sufficiently large to hold American books of music which are normally a standard 12" in height, and foreign music books which may be one-quarter inch higher than their American counterparts. The musical assembly (10) can be readily adjusted to encompass any size page of bound music including larger size operatic folios published abroad and smaller American hymn books.

In use, once one has selected the particular pages of music it is desired to play from, for example pages 40–42 of an 80 page book, pages 1–39 are inserted into the left pocket (24) (FIG. 4) of the holder (10) and pages 43–80 are placed in the right pocket (26), with the remaining pages 40–42 left free. A stiffener (36) is inserted over each of the free pages, with the thickened or stiffening strip (37) (FIG. 6) toward the center fold (40) of the music page (39) and at the rear thereof, leaving the shorter plane (46) (FIG. 6) of the stiffener (36) at the front of the music page (39).

A tab (41) is then engaged with the outer edge (38) of each stiffener (36), with each tab (41) spaced from each adjacent tab (41), as best illustrated in FIG. 5, to ensure that each tab may be readily and quickly engaged to turn the appropriate page. The grasp of each tab (41) is enhanced by the rib (38) being larger and thicker than the two panels (46), (47) of the stiffener (36). Although not shown, the tabs (41) may have different colors, and the player may arrange a personal color progression of tabs to help him or her turn pages quickly. The thickness of the tabs (41) (FIG. 8) also separates the music pages such that the player may readily and surely insert his or her finger(s) behind the tab to flip or otherwise quickly turn the page, rather than necessitating the grasping of a tab (41) by at least two fingers.

Referring to FIGS. 10–13, a modified embodiment of the invention is disclosed, like parts being referred to by like reference numerals as to the FIGS. 1–9 embodiment.

Figure 13:
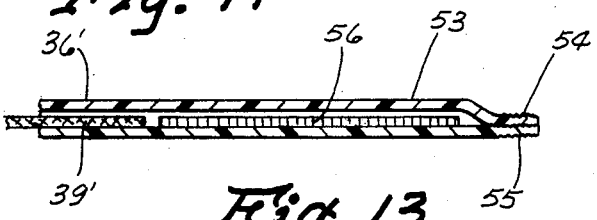
FIG. 13 is an enlarged sectional view taken along the line 13—13 in FIG. 12.

It is to be noted that the front cover pieces (22') are shown here as being of transparent material should it be desirable to see through the cover pieces (22') to read the music printed on the top pages of material (51), (52) held and partially covered by the cover pieces (22'). Further, rather than the separate tabs (41), each page stiffener (36') has a tab (53) (FIG. 12) integral therewith. As best shown in FIG. 13, the envelope nature of the stiffener (36') is continued into each tab (53), the outer ends (54), (55) being sealed to complete the envelope.

Importantly, this provides for a color layer (56) being applied to an inner surface of the tab (53), which color layer (56) is viewed from both sides of the tab (53). By this arrangement, each page of music which is held within page stiffener (36') may be color coded for ease and accuracy of page choice and turning. Further, by enclosing the color layer (56) within its own plastic envelope, wear and loss of color is virtually eliminated.

In the FIGS. 10–13 embodiment, the riser flap (29) (FIG. 3) is eliminated and its function replaced by another means. Slightly above the bottom edge (57) of each backing member (18'), (19'), each front cover piece (22') is sealed against the respective member (18'), (19') along a seam (58) extended parallel to the bottom edges (57). This shortens slightly the depth of the pocket formed by each cover piece (22'); however, when the music (59) is placed within the left and right pockets, in the manner shown at (24) and (26) of FIG. 4, the bottom edge (27') of the music (59) is supported by the seams (58) raised above the backing member bottom edges (57). Should the music holder assembly be placed on an instrument, such as a piano (12) shown in FIG. 1, the bottom edges (27') of the music (59) would be held above any music supporting surface thereof, such as the piano ledge (14) or restraining ridge (16), obviating thereby any frictional engagement therebetween. This condition holds true, further, when the page stiffeners (36') are applied to the music pages, (39') for example, not held bound within the pockets (24'), (26).

I claim:

1. A music page holder and turner assembly for holding sheet music, the assembly comprising:

(a) support means adapted to embrace and hold the sheet music in an open manner and with part of the sheet music held together to the left of the viewer, with part of the sheet music held together to the right of the viewer and with part of the sheet music left free and un-embraced between the left and right held music pages, said support means having a backing member foldable centrally thereof and with a bottom edge; and (b) means provided for stiffening each free page, which stiffening means comprises a transparent envelope for receiving each free page whereby each stiffened page is adapted to rest relatively flat against the held music to the players right or left, the closed edge of said stiffening means disposed outwardly of each free page.

2. The music page holder and turner assembly of claim 1 wherein means is provided for aiding the turning each free page, which turning means comprises a portion of each stiffening means outer edge extended further outwardly therefrom to form a tab-like portion easily grasped by the fingers.

3. The music page holder and turner assembly of claim 1 wherein the rear panel of said transparent envelope has a strip along the entire inner open portion thereof which is more thick than the remainder of the envelope panels to form an additional stiffening means.

4. The music page holder and turner of claim 1 wherein said sheet music holder means comprises further a pair of backing members of equal size and shape flexibly retained together along their inner edges, and an enclosure member secured to the inner face of each backing member and forming thereby a pocket on each inner face and open toward the center flexible joint, each pocket capable of holding at least the outer portions of one or more pages of music.

5. A music page holder and turner assembly of claim 2 wherein an element of a predetermined color is enclosed within each said tab-like stiffening means portion, a plurality of tab-like portions adapted to have a like plurality of different colors for page turning sequence purposes.

6. A music page holder and turner assembly of claim 4 wherein said enclosure members are of transparent material.

* * * * *